United States Patent [19]

Reuter et al.

[11] 4,158,031

[45] Jun. 12, 1979

[54] ELECTRICALLY CONDUCTIVE FOAM MOULDINGS

[75] Inventors: Franz G. Reuter, Lemförde; Tankred Menzel, Bad Essen, both of Fed. Rep. of Germany

[73] Assignee: Reuter Technologie GmbH, AM Rauhen Berge, Lemförde, Fed. Rep. of Germany

[21] Appl. No.: 782,074

[22] Filed: Mar. 28, 1977

[30] Foreign Application Priority Data

Apr. 23, 1976 [DE] Fed. Rep. of Germany ..... 2617698

[51] Int. Cl.[2] ..... B29D 27/00; B65D 11/00

[52] U.S. Cl. ..... 521/57; 252/511; 427/222; 264/51; 264/45.4; 521/59

[58] Field of Search ..... 427/222, 58; 252/511; 260/2.5 B; 264/45.3, 45.4, 51, 53

[56] References Cited

U.S. PATENT DOCUMENTS

| | | | |
|---|---|---|---|
| 3,154,604 | 10/1964 | McMillan | 264/46.3 |
| 3,412,185 | 11/1968 | Klenzle | 264/51 |
| 3,826,765 | 7/1974 | Altares | 260/901 |
| 3,887,754 | 6/1975 | Walter | 264/53 |
| 4,020,133 | 4/1977 | Altares | 264/53 |

*Primary Examiner*—Sam Silverberg

*Attorney, Agent, or Firm*—Stevens, Davis, Miller & Mosher

[57] ABSTRACT

This invention relates to electrically conductive foam moulding manufactures from electrically conductive polystyrene beads containing blowing agent.

2 Claims, No Drawings

ELECTRICALLY CONDUCTIVE FOAM MOULDINGS

The present invention relates to electrically conductive foam mouldings of polystyrene, their use and a process for the manufacture of these foam mouldings.

It is known to employ polystyrene foams, which are manufactured from polystyrene beads containing blowing agent (the beads being commercially available under the name "Styropor") on an extensive scale as packaging materials. However, for numerous fields of packaging these foam plastics cannot be used, since they generate, or carry, substantial electrostatic charges. For this reason, numerous materials such as MOS electronic circuits, explosives, plastic lenses and dust-attracting objects must not be brought into contact with Styropor packaging containers. It is true that so-called "antistatic" grades of Styropor are already commercially available, but these do not exhibit the desired electrical conductivity or neutrality.

It is therefore the object of the invention to provide Styropor packaging containers which possess the desired electrical conductivity properties, the starting point being that the object of the present invention is not achieved fully if it is only the surfaces of the Styropor packaging containers which are provided with an electrically conductive layer. It is true that by using the latter method the electrical charge adhering to the surfaces of articles can be conducted away, or the accumulation of an electrostatic charge can be prevented, but what cannot be prevented is the penetration of alternating fields through the walls of the packaging material, which causes damage to delicate electronic components, for example MOS components. The prevention of these effects is only achievable if the walls of the packaging materials possess, throughout, a certain homogeneous electrical conductivity. Such a homogeneously conductive packaging article then possesses the property of also absorbing the abovementioned alternating fields and of, at the same time, destroying static fields.

According to the invention, this object is achieved by a process in which the electrically conductive foam mouldings are manufactured from polystyrene beads containing blowing agent (Styropor), which, before the final foaming process, have been treated with an aqueous plastics dispersion containing electrically conductive particles.

Styropor is a polystyrene containing blowing agent and is marketed in the form of beads or small rods. The polystyrene beads have a diameter of about 0.2 to 2.5 mm. Because of the content of blowing agent, the individual polystyrene beads expand on warming to 90°-110° C. to give closed cell particles. The cell formation is accompanied by an increase in volume which may be more than fifty times the original volume. The foaming process normally takes place in two stages. In the first stage of the foaming process, the polystyrene is prefoamed until a bead diameter of 2 to 3 mm is reached, if polystyrene beads having a diameter of about 0.5 mm are used as the starting material. In the second stage of the foaming process, the prefoamed beads are introduced into the mould and expanded, under the action of heat, until a pressure of about 1 atmosphere gauge at 105° C. is generated in the mould. In the course of this process, the individual polystyrene beads are at the same time thermoplastically welded to form the moulding.

The treatment, according to the invention, of the polystyrene beads can be carried out before the first foaming stage, but preferably after the first foaming stage, and before the second foaming stage.

The aqueous plastics dispersion, containing the electrically conductive particles, which is employed for the treatment according to the invention, should preferably conform to the following conditions:

1. During the increase in volume, it should elastically adapt to the surface of the polystyrene beads and should ensure good adhesion to the spherical surface.

2. It should not affect, or disturb, the thermoplastic welding of the individual polystyrene beads.

3. It should not be so tacky as to cause the polystyrene beads to stick together already during the treatment according to the invention.

Since the Styropor structure would be destroyed on contact with organic solvents, an aqueous plastics dispersion, which when used produces quite specific effects, is employed in accordance with the invention.

Preferably, a film-forming plastics dispersion is employed, which both possesses elastic properties and also forms intentional flaws which have the result that, on stretching, the elastic film tears open at the statistically predeterminable flaws or intended breakage points and thus forms a fine network which permits thermoplastic welding of one polystyrene bead to the next. Accordingly, the aqueous plastics dispersion is compounded so that the electrically conductive film which forms from the aqueous plastics dispersion tears open at locally confined points, when a certain extension is reached. The aqueous plastics dispersion is preferably manufactured by mixing a film-forming plastics dispersion, for example "Acronal", having an extensibiliby of 2,000%, with a non-film-forming polystyrene/carbon black dispersion, for which purpose it is possible to use, for example, about 35 parts by weight of "Styrofan" per 100 parts by weight of "Acronal". Before the polystyrene dispersion is introduced into the Acronal dispersion, the polystyrene dispersion must be mixed with a carbon black dispersion, which results in the polystyrene particles being surface-coated with conductive carbon black pigments. The tradename "Acronal" covers plastics dispersions based on acrylic esters and/or copolymers of these, whilst the trade name "Styrofan" covers plastics dispersions based on polystyrene and/or polystyrene copolymers.

The electrically conductive particles contained in the aqueous plastics dispersion may consist of carbon, for example carbon black or graphite, of noble metal or of other metals, or other non-metals, coated with noble metal. Carbon black, especially an acetylene carbon black, for example as commercially available in the form of an aqueous dispersion, is employed preferentially.

The example which follows illustrates the invention without limiting it thereto.

100 parts by weight of an aqueous 50% strength polystyrene dispersion (Styrofan 2D BASF) are introduced into 200 parts by weight of a 30% strength aqueous carbon black dispersion (Corax L). After stirring for 6 minutes, the mixture is introduced into 300 parts by weight of an aqueous 50% strength polyacrylic ester dispersion (Acronal) and the batch is stirred for 10 minutes.

The polystyrene beads, which have already been prefoamed and have a diameter of about 2 mm, are fed into a slow-running mixer, about 40 g of the above plastics dispersion being introduced for a volume of 1,000 $cm^3$ of polystyrene beads. After about 5 minutes mixing time, all beads have been coated on the surface with the plastics dispersion. The beads, which are still moist at the surface, are dried for about 5 minutes with air warmed to 40° C.

The beads are then introduced into the metal mould, the volume introduced being so calculated as to allow the beads to expand by approximately a further 30%. The beads are then caused to expand with live steam at 105° C., until a pressure of about 1 atmosphere gauge is set up. The finished moulding is electrically conductive.

What we claim is:

1. A process for making molded electrically conductive foam products which comprises heating polystyrene beads containing a blowing agent to expand the beads to form closed cell polystyrene foam particles, coating said particles by forming a mixture containing a film forming polyacrylate ester and a non-film forming polystyrene dispersion of carbon black whereby a non-continuous coating is produced, placing the partially coated particles in a mold and heating the mold's contents to about 105° C. until the prefoamed beads expand and develop a pressure of about 1 atmosphere gauge in the mold and the beads are welded together.

2. A process for making electrically conductive foam moldings which comprises mixing prefoamed polystyrene particles containing a blowing agent with an aqueous film forming polyacrylic ester dispension containing carbon black particles and expanding the resulting mixture in a mold to form a foam molding in which the said polystyrene particles are coated with electrically conductive particles and are welded together to form a foam molding.

* * * * *